US005705967A

United States Patent [19]

Pirard

[11] Patent Number: 5,705,967

[45] Date of Patent: Jan. 6, 1998

[54] HIGH-FREQUENCY RADIATING LINE

[75] Inventor: Willy Pirard, Neupré, Belgium

[73] Assignee: Institut Scientifique de Service Public, Liège, France

[21] Appl. No.: 628,908

[22] Filed: Apr. 8, 1996

[30] Foreign Application Priority Data

Apr. 7, 1995 [BE] Belgium ..... 09500322

[51] Int. Cl.[6] ..... H01Q 13/10

[52] U.S. Cl. ..... 333/237; 343/771

[58] Field of Search ..... 333/237; 343/770, 343/771

[56] References Cited

U.S. PATENT DOCUMENTS 3,795,915 3/1974 Yoshida ..... 333/237 X 4,373,162 2/1983 Peterson ..... 343/771

*Primary Examiner*—Paul Gensler

*Attorney, Agent, or Firm*—Abelman, Frayne & Schwab

[57] ABSTRACT

The line comprises a tubular outer conductor including apertures configured to form a periodic pattern (M) repeated along said outer conductor with a predetermined pitch (p). The periodic pattern has a length (L) equal to p/2±Δ, along a direction parallel to the axial direction of the line. The periodic pattern can be produced in various embodiments.

6 Claims, 9 Drawing Sheets

HIGH-FREQUENCY RADIATING LINE

The invention relates to a high-frequency radiating line which is particularly appropriate for establishing radio frequency links with mobile apparatus along an axis and, in particular, in confined environments such as tunnels, subterranean galleries, underground railways, as well as buildings.

The use of high-frequency radiating lines these environments is increasingly of interest, as a result of the rapid development of mobile communications systems (radio links, cellular telephones, cordless telephones, etc.).

Moreover, such high-frequency radiating lines can also be used when it is attempted to guide radio frequency waves along an axis on the surface, generally a transport route, road, or railway.

A high-frequency radiating link consists of a cable or of a waveguide capable of radiating outwards some of the electromagnetic energy which it transports. In what follows, consideration will be given more particularly to radiating cables.

Various types of radiating cables are known; they generally consist of a coaxial cable comprising an inner conductor surrounded by a dielectric and by an outer conductor (screening) of tubular form, pierced by apertures for the electromagnetic radiation to pass. The whole is covered by an insulating outer sheath.

The apertures formed in the outer conductor may be of various types, for example a longitudinal slot over the whole length of the cable, or numerous small holes very close to one another. There also exist cables in which the outer conductor consists of a loose braiding, or sometimes of a layer of wires would in a spiral around the dielectric. The common characteristic of these cables is that they possess apertures over the entire length the outer conductor, or apertures separated by a distance considerably less than the wavelength of the radiated signal.

All the cables mentioned above operate in a mode known as "coupled" mode. In principle, the radiated energy propagates parallel to the cable and falls off rapidly when moving away in the direction perpendicular to the axis of the cable. Moreover, this field fluctuates greatly when the receiving antenna is shifted parallel to the cable.

An embodiment is also known (BE-A-834291) consisting of a non-radiating coaxial cable in which radiating segments of very short length with respect to the spacing between segments are inserted. This embodiment also falls into the category of coupled-mode cables, since the said segments operate in coupled mode.

A more recent technique has proposed a cable known as "radiated mode" cable, in which the outer conductor includes apertures (or groups of apertures) which form a pattern reproduced with a regular pitch, the pitch of the pattern being of the same order of magnitude as the wavelength of the signal to be radiated.

For wavelengths longer than the longest wavelength from which the cable operates in radiated mode, the cable operates in coupled mode. It is thus the ratio between the wavelength of the signal transmitted and the pitch of the pattern which determines the operating mode.

The radiation produced by these cables is emitted in a radial direction, forming an angle with the axis of the cable which lies between 0° and 180°.

The main advantages of the radiated-mode cable are:

a decrease of the field when moving away from the cable in the radial direction which is smaller than in the case of coupled-mode cables;

slight fluctuations in the field when moving parallel to the axis of the cable.

However, the second advantage mentioned above (slight fluctuations of the field) exists only in a frequency band stretching from $f_{min}$ to $2\times f_{min}$, in which there is only one preponderant radiated mode, also called principal radiated mode. This principal mode corresponds to a radiation pattern exhibiting a single preponderant lobe.

Beyond $2\times f_{min}$, side lobes are emitted along directions different to the principal lobe. The higher the frequency, the more numerous are these modes. The amplitude of the secondary lobes is comparable to that of the principal lobe. These different lobes interfere with each other. This results in significant fluctuations in the field when moving along the cable and, consequently, it is impossible to predict with precision the level of the radiated field, at a certain distance from the cable. This obliges the designer of the installation to increase the powers emitted so as to guarantee that the electromagnetic field actually reaches the required levels. Such a cable is therefore beneficial only to the extent that it emits only the principal radiated mode, which limits the useful frequency band to one octave.

For economic reasons, it is vital to be able to retransmit several signals on the same cable. The frequencies of these signals are almost always spread over a band greater than one octave, which obviously limits the advantages of such a solution.

A widening of the useful frequency band is impossible with a simple periodic pattern. It is then necessary to use a more complex periodic pattern so as to eliminate or attenuate a certain number of secondary modes. To this end, various solutions have been proposed. They all have their drawbacks.

DE-A-2, 812, 523 describes a pattern which, with the aim of producing a periodic profile of the radiation intensity in the direction of the axis of the line, consists of apertures of the same size and of the same shape, the density of which varies periodically along the cable. The distribution of the apertures is such that, in the regions of greater radiation intensity, the number of apertures per unit of surface area, which are situated side by side in the peripheral direction and/or in the axial direction, is higher than in the regions of lesser radiation intensity. As the holder of the abovementioned patent indicates, the purpose of such a pattern is to produce a periodic profile of the radiation intensity in the direction of the axis of the line. Moreover, this document does not give the extent of the frequency band in which the secondary lobes are attenuated.

GB-A-1, 481, 485 describes a periodic pattern consisting of two principal slots and of four auxiliary slots. The auxiliary slots are arranged on either side of each of the principal slots. In this device, the secondary lobes appearing at the frequencies lying between $f_{min}$ and $5\times f_{min}$ are negligible or almost zero. Moreover, a pattern of greater size would include ten slots and, consequently, would be difficult to produce in practice, since the total length of the apertures would be such that it would weaken the mechanical strength of the outer conductor.

FR-A-2 685 549 describes a pattern including N apertures, the useful frequency band of which lies between $f_{min}$ and $N\times f_{min}$.

The patterns described in these last two documents have the drawback that apertures are present over almost the whole length of the cable, which has the effect of reducing the mechanical strength. It is well known, in fact, that deformations of the cable or of the apertures formed in the outer conductor can greatly affect the performance obtained. The phenomena generally observed are:

an increase in the attenuation per unit length of the cable, a modification of the radiation produced by the deformed apertures, which will counteract the principle at the base of the cancellation of the secondary modes, the onset of a coupled mode which generates substantial fluctuations in the field when moving parallel to the cable.

Another drawback of these known solutions is the difficulty of producing oblique slots (different inclination) on certain types of cable constructions: this is the case particularly when the outer conductor is corrugated.

Document DE-G-9, 318, 420 describes a solution which uses a corrugated outer conductor. No mention is made of the elimination of secondary lobes.

The purpose of the present invention is to avoid the drawbacks of known radiating cables. To this end, it proposes to use a periodic pattern (consisting of a single aperture or of a group of apertures close together) the length of which is chosen in such a way as to eliminate or attenuate a certain number of secondary lobes.

This objective is achieved by a high-frequency radiating line as defined in the claims.

The invention is set out in more detail in what follows, with the aid of the attached drawings.

Figure 1:
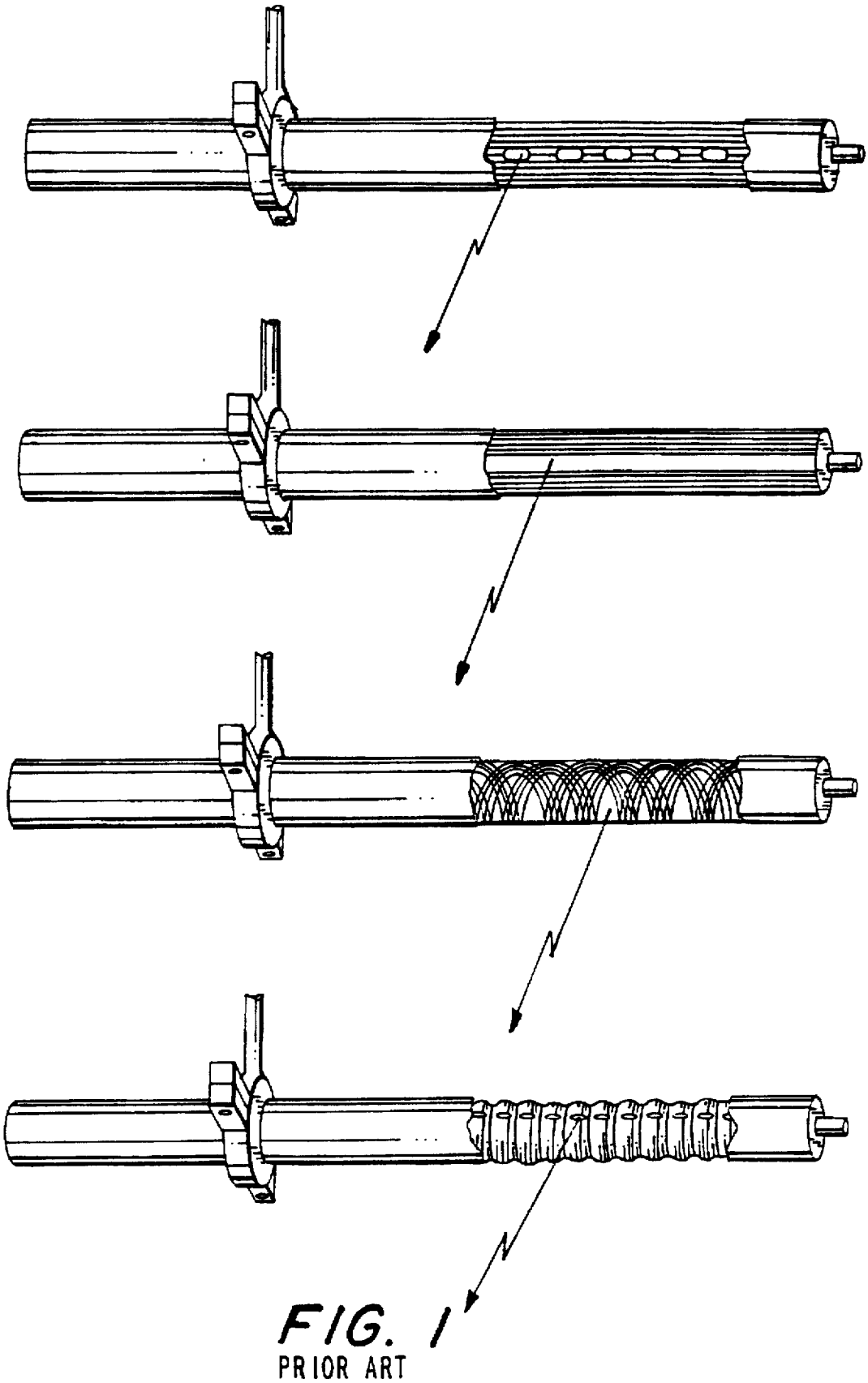
FIG. 1 PRIOR ART
FIGS. 1 to 3 illustrate a few types of radiating cable representing the prior state of the art.
Figure 2:
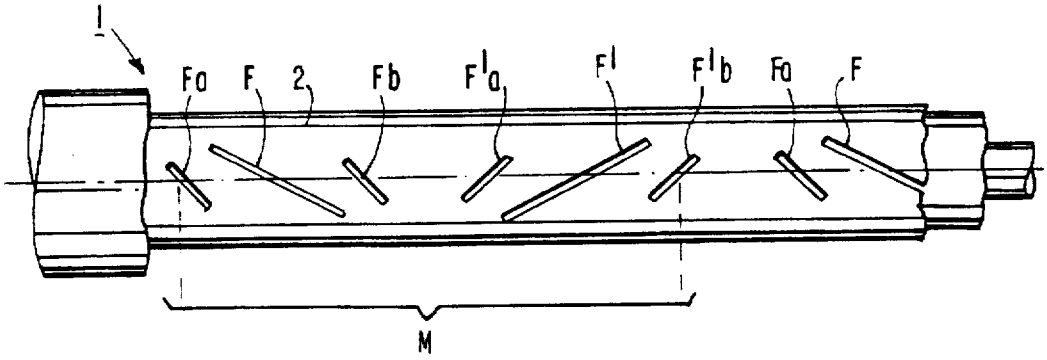
FIG. 2 PRIOR ART
Figure 3:
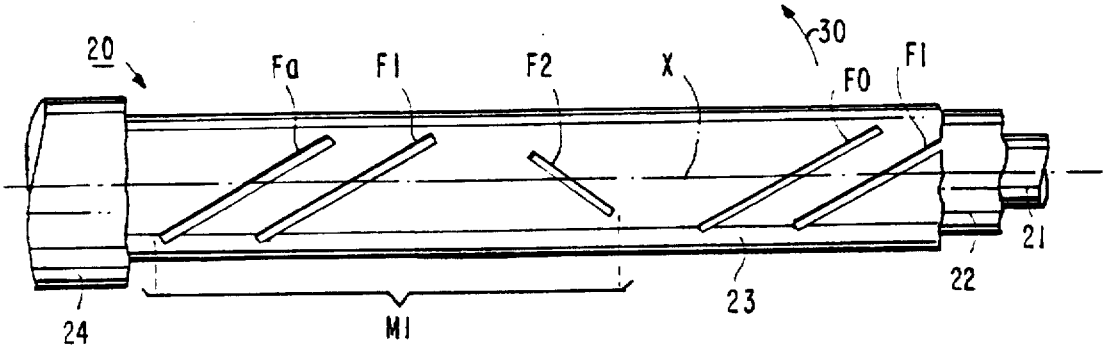
FIG. 3 PRIOR ART

Before describing the invention, reference will briefly be made to FIGS. 1 to 3 which illustrate the state of the art. FIG. 1 shows four types of radiating cable including either apertures distributed over the whole length of the outer conductor, or a longitudinal slot over the whole length of the outer conductor. FIG. 2 represents a segment of radiating cable the periodic pattern of which includes two principal oblique slots F and F', and four auxiliary oblique slots Fa, Fb, Fa', Fb' as disclosed by GB-A-1, 481, 485 mentioned above. FIG. 3 represents a segment of radiating cable, the outer conductor of which also includes a periodic pattern consisting of oblique slots the inclinations of which are different. The drawbacks of these known radiating cables were set out above.

In accordance with the invention, the pattern includes a single radiating section the length L of which is equal to p/2. It can be shown that the effect sought is obtained as long as L lies in a range of about 10%, on either side of this value.

The outer conductor thus includes a periodic pattern of pitch p which is determined by the relation:

$$p = \frac{\lambda_{start}}{\sqrt{\epsilon_r} + 1} \quad (1)$$

in which:

$\lambda_{start}$: greatest wavelength from which the cable operates in radiated mode $\epsilon_r$: relative dielectric constant of the cable.

The pattern comprises a single radiating section of length L=p/2 (±10%), and a non-radiating section of equal length. The length of the radiating and non-radiating sections, as well as the distance between the apertures of the radiating section, are always measured in the direction parallel to the axis of the cable.

Figure 4:
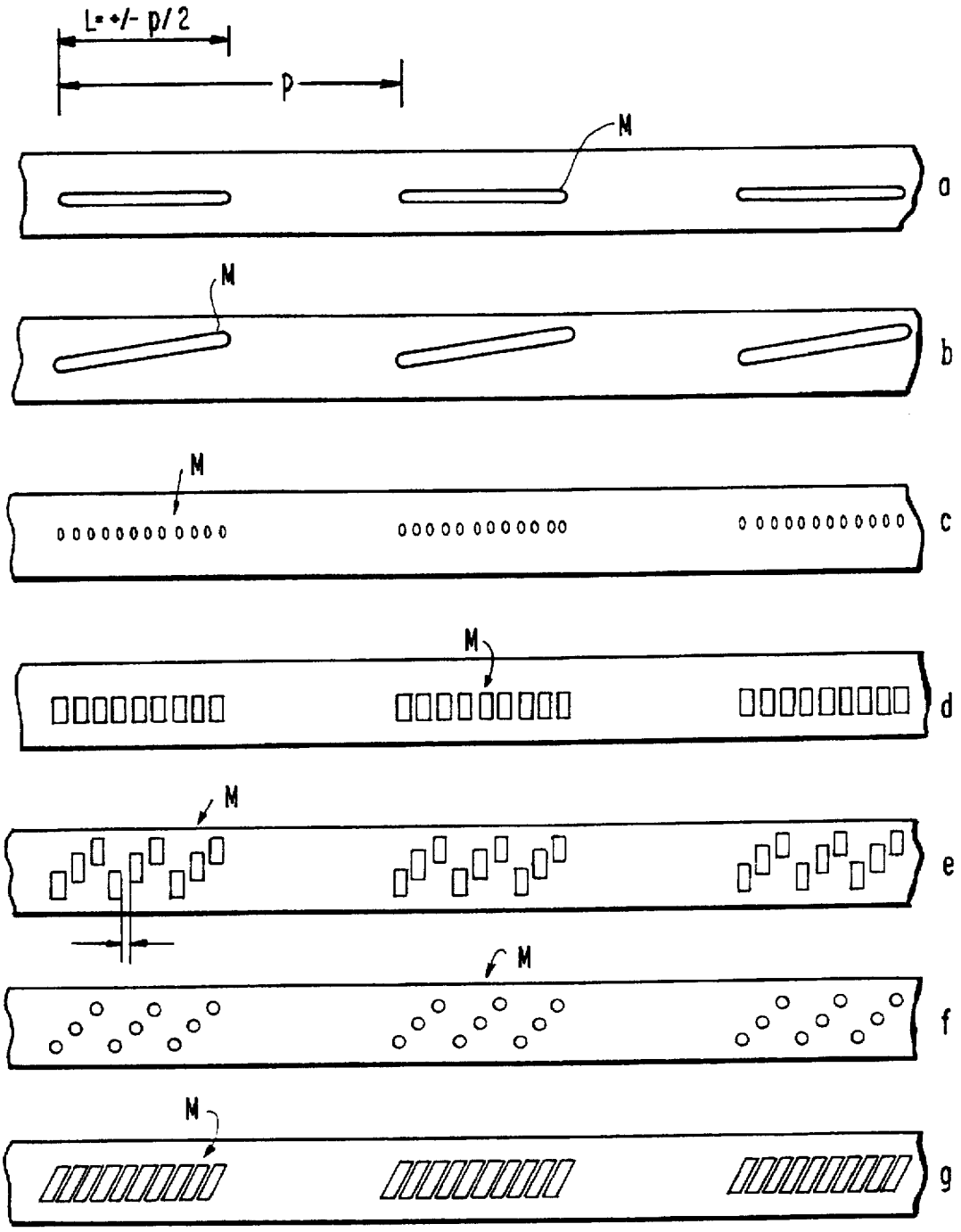
FIG. 4 represents a few exemplary embodiments of the invention.

The radiating section of length L can be produced in various ways (FIG. 4). It may consist of a slot of length L formed in the generatrix of the outer conductor (FIG. 4*a*). This slot may also be oblique with respect to the axis of the cable (FIG. 4*b*); in this case, it is the length of its projection into a plane containing the axis of the line which should be equal to p/2.

With such a pattern, the frequency band in which the secondary lobes are totally canceled lies between $f_{min}$ and $3 \times f_{min}$.

Beyond $3 \times f_{min}$, the secondary lobes, although heavily attenuated, give rise to a certain degradation in performance. Nonetheless, the fluctuations are less severe than with a coupled-mode cable.

In other embodiments, the radiating section can consist of a group of identical apertures, regularly spaced and fairly close together, the projections of which onto a plane containing the longitudinal axis of the line are equidistant.

FIGS. 4*c* to 4*g* illustrate a few examples. It will be noted that the apertures do not necessarily have to he aligned along the axial direction of the line; they may have any shape (square, rectangular, circular, elliptical, etc.). The length of the radiating section as well as the distance between the apertures of said section are always measured along the direction parallel to the axis of the cable. For preference, the radiating section should include at least six apertures. The outer conductor may he of any type (flat, corrugated, peened, etc.).

It is known to the person skilled in the art that the type of slot, and more particularly its inclination, determines the direction of polarization of the radiated signal. For example, an aperture parallel to the axis of the cable (FIG. 4*a*) produces an electric field the dominant component of which is also parallel to the cable. This is also the case for patterns consisting of small holes close together (FIG. 4*c*) or including transverse slots (FIG. 4*d*).

Figure 5:
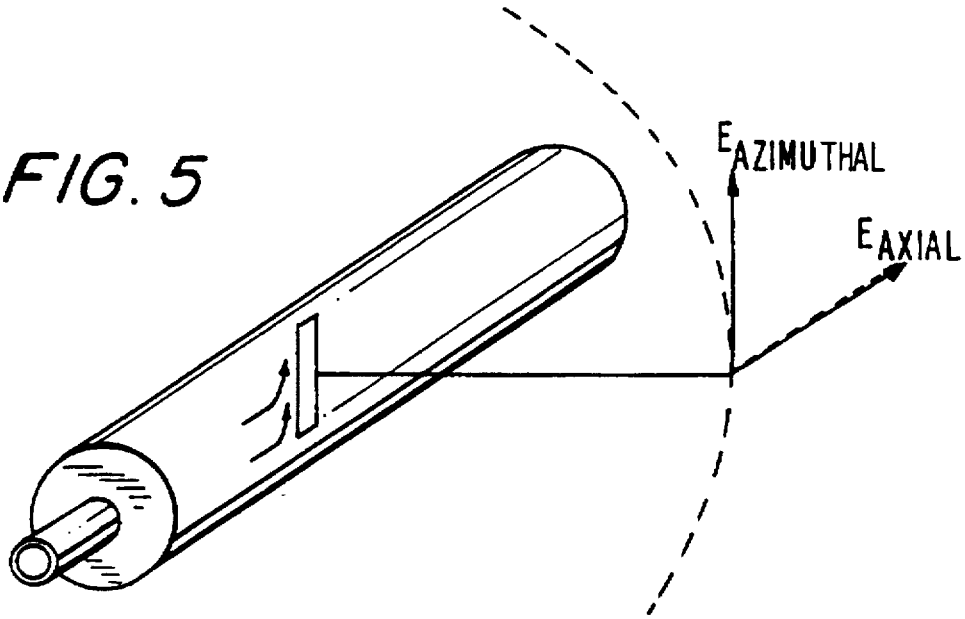
FIGS. 5 and 6 are electric field diagrams relating to embodiments of the invention.

On the other hand, a slot which is oblique with respect to the axis of the cable, as represented in FIG. 4*b*, imposes an oblique trajectory on the lines of current flowing along the outer conductor. These oblique lines of current generate an electric field including an axial component and an azimuthal component (FIG. 5). For the same reasons, the pattern of FIG. 4*g*, which consists of small oblique slots close together, also generates a field having an axial component and an azimuthal component.

Figure 6:
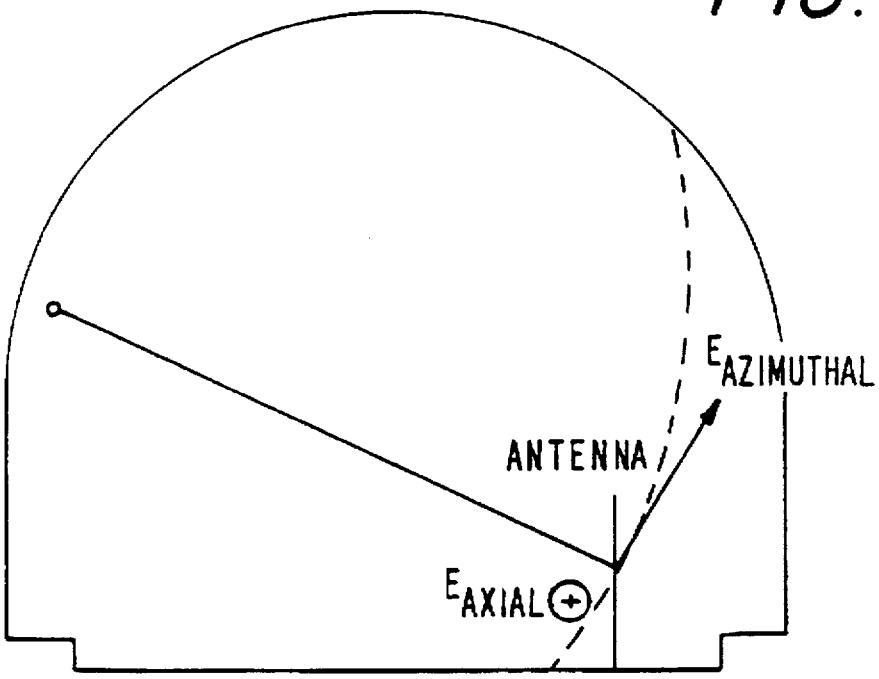

From the practical point of view, it is beneficial for the radiating line to produce an axial component and an azimuthal component. In fact, if the axial component existed alone, it would be absolutely necessary to orient the antenna of the mobile equipment parallel to the cable. However, in the majority of applications, the antenna of the mobile equipment is vertical, giving rise to the importance of the azimuthal component which, in this case, is the only one capable of producing a current in the antenna, as illustrated in FIG. 6.

The sections consisting of several apertures have the advantage of only very slightly diminishing the mechanical strength of the outer conductor.

It should be noted that the principle developed is applicable to radiating cables, as well as to radiating waveguides. The latter are of a construction identical to that of the cables, but do not include an inner conductor.

The length of the slots and useful frequency band of the cable are determined as follows.

Let us consider a radiating cable the outer conductor of which includes a periodic pattern of pitch p, the pattern consisting of a single aperture. It is known to the person skilled in the art that such a cable produces radiation propagating in the radial direction, also called radiated mode, for frequencies equal to or greater than a frequency $f_{start}$ which is given by relation (2)

$$f_{start} = \frac{c}{p(\sqrt{\epsilon_r} + 1)} \tag{2}$$

where c represents the speed of light in air.

A wavelength corresponds to this frequency, given by:

$$\lambda_{start} = p(\sqrt{\epsilon_r} + 1) \tag{3}$$

The direction of propagation of the radiation forms an angle θ with the axis of the cable, which angle is counted positively starting from the generator toward the end of the cable.

Figure 7:
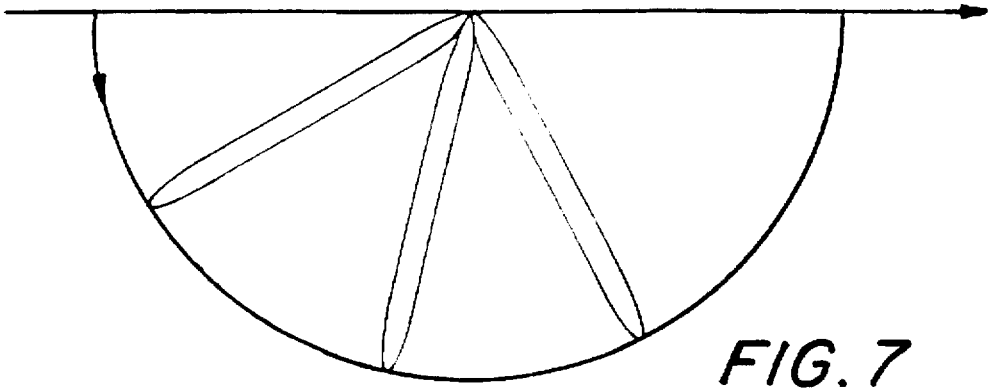
FIG. 7 represents the radiation pattern obtained with a radiating line with a periodic pattern.

It is also known to the person skilled in the art that this radial radiation gives rise to lobes (also called modes) as illustrated in FIG. 7. The maxima of these lobes form an angle $\theta_{max,k}$ with the axis of the cable, which angle is given by the following relation:

$$\cos\theta_{max,k} = \frac{k\lambda}{p} - \sqrt{\epsilon_r} \text{ with } k\,0 = 1,2,3,\text{etc.} \tag{4}$$

where θmax,kcorresponds to the maximum of the lobe of order k.

Taking relation (1) into account, then:

$$\cos\theta_{max,k} = \frac{k\lambda(\sqrt{\epsilon_r} + 1)}{\lambda_{start}} - \sqrt{\epsilon_r} \text{ with } k = 1,2,3,\text{etc.} \tag{5}$$

As long as λ remains greater than $\lambda_{start}/2$, the expression (5) has a solution only for k=1.

As soon as λ becomes less than $\lambda_{start}/2$, the expression (5) has two solutions which are:

$$\cos\theta_{max,1} = \frac{\lambda(\sqrt{\epsilon_r} + 1)}{\lambda_{start}} - \sqrt{\epsilon_r} \tag{6}$$

$$\cos\theta_{max,2} = \frac{2\lambda(\sqrt{\epsilon_r} + 1)}{\lambda_{start}} - \sqrt{\epsilon_r} \tag{7}$$

in which:

$\theta_{max,1}$=angle giving the direction of the maximum of the primary lobe (k=1)

$\theta_{max,2}$=angle giving the direction of the maximum of the secondary lobe (k=2).

In the same way, when λ becomes less than $\lambda_{start}/3$, a primary lobe (k=1) and two secondary lobes (k=2 and k=3) appear. If λ continues to decrease, other secondary lobes appear and their radiation direction is given by relations (4) or (5).

Such a radiating cable is beneficial only in the frequency band $|f_{start}, 2\times f_{start}|$. For frequencies above this band, the secondary lobes interfere with the primary lobe, which generates significant fluctuations in the field when moving parallel to the cable.

The useful range can be widened only by eliminating or attenuating a certain number of secondary lobes (starting with the lobe k=2).

The solution according to the invention consists in exploiting the directional nature of an aperture or of a group of closely spaced apertures.

Figure 8:
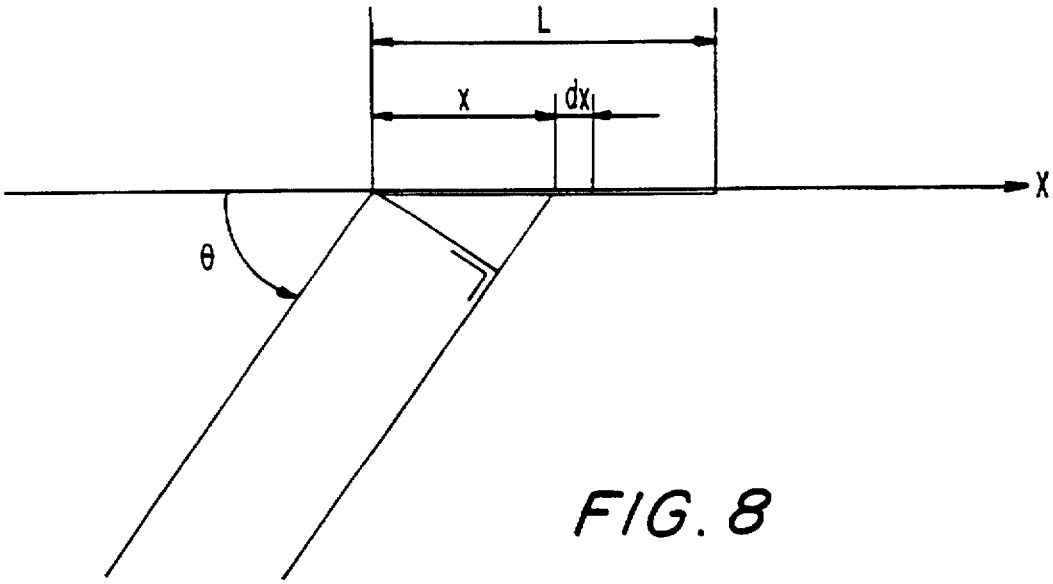
FIG. 8 is a diagram explaining the parameters coming into play in determining the length of a pattern according to the invention.

Let us determine the radiation pattern, in the axial plane of the cable, of a slot of length L formed along a generatrix of the outer conductor as illustrated in FIG. 4*a*. Let us take, as origin of the abscissae, the end of the slot situated on the generator side, and let us represent, at FIG. 8, the axis of the abscissae (which coincides with the axis of the cable) and the slot of length L.

In the direction θ, the field produced by an infinitesimal segment dx situated at the abscissa x exhibits, with respect to that originating from the same infinitesimal segment situated at x=0, a propagation delay T given by the following relation:

$$\tau = \frac{x}{v} + \frac{x\cos\theta}{c} = \frac{x}{c}(\sqrt{\epsilon_r} + \cos\theta) \tag{8}$$

in which v is the speed of propagation of the signal in the cable, which is equal to $c/\sqrt{\epsilon_r}$.

For a sinusoidal current, the expression of the field produced by this segment dx is of the type:

$$ds = \sin\omega\left[t - \frac{x}{c}(\sqrt{\epsilon_r} + \cos\theta)\right]dx \tag{9}$$

The total field produced by the complete slot is obtained by integrating the contributions from each of the infinitesimal sections, that is to say:

$$s = \int_O^L \sin\omega\left[t - \frac{x}{c}(\sqrt{\epsilon_r} + \cos\theta)\right]dx \tag{10}$$

Ignoring the minus sign, and taking into account that:

$$\frac{c}{\omega} = \frac{\lambda}{2\pi} \tag{11}$$

there is obtained:

$$s = \frac{\lambda}{\pi(\sqrt{\epsilon_r} + \cos\theta)} \sin\left[\frac{\pi L}{\lambda}(\sqrt{\epsilon_r} + \cos\theta)\right] \sin\omega\left[t - \frac{L}{2c}(\sqrt{\epsilon_r} + \cos\theta)\right] \tag{12}$$

The last factor of this expression depends on time and does not affect the amplitude of the signal.

The radiation pattern thus depends only on the first two factors, which can be expressed in the following form:

$$f(\theta) = L\frac{\sin[(\sqrt{\epsilon_r} + \cos\theta)\pi L/\lambda]}{(\sqrt{\epsilon_r} + \cos\theta)\pi L/\lambda} \tag{13}$$

In order to simplify the study of this function, let us set:

$$\alpha = (\sqrt{\epsilon_r} + \cos\theta)\pi L/\lambda \tag{14}$$

In this case, $$f(\theta) = L(\sin\alpha)/\alpha \tag{15}$$

In a radiation pattern, having regard to the symmetry of revolution, θ varies between 0° and 180°.

For θ=0° and θ=180°, α is given by the following expressions:

$$\alpha_{0°} = (\sqrt{\epsilon_r} + 1)\pi L/\lambda \quad (16)$$

$$\alpha_{180°} = (\sqrt{\epsilon_r} - 1)\pi L/\lambda \quad (17)$$

It is noted that $\alpha$ is always positive and decreases when $\theta$ increases.

Let us determine the zeros of $f(\theta)$. A $\sin\alpha/\alpha$ function cancels out for:

$$\alpha = l\pi \text{ with } l=1, 2, 3, \text{etc.} \quad (18)$$

It should be noted, on the one hand, that the value $l=0$ is to be rejected since $\alpha$ is strictly positive and, on the other hand, that the interval of existence of $\alpha$ is fairly large given the value of the following ratio:

$$\frac{\alpha_{0°}}{\alpha_{180°}} = \frac{(\sqrt{\epsilon_r} + 1)}{(\sqrt{\epsilon_r} - 1)} \quad (19)$$

Figure 9:
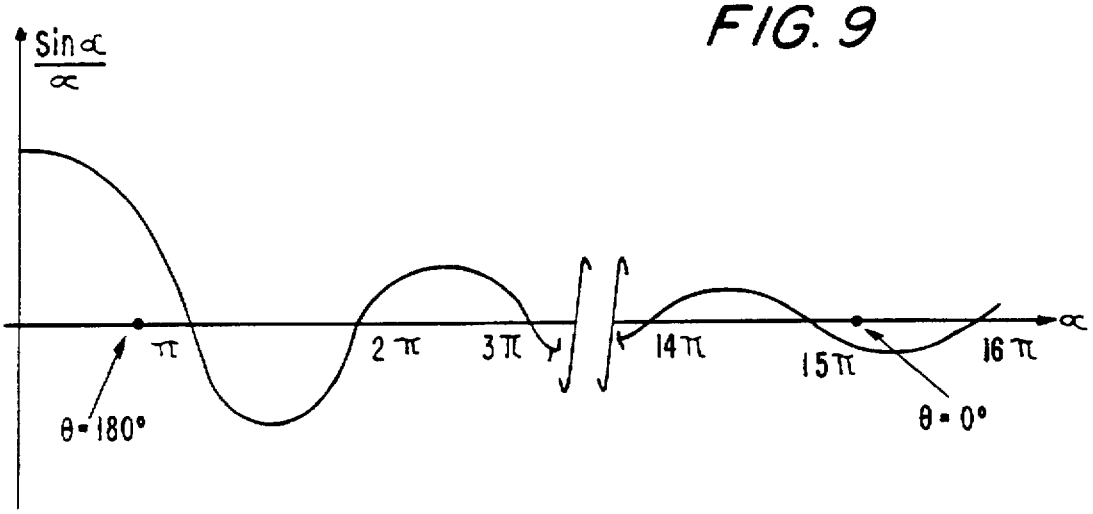
FIGS. 9 and 10 represent the function of the field produced by a slot having different lengths.

In the case of polyethylene, for example, $\epsilon_r=1.29$, this ratio is approximately 15.7. This means that the interval of existence of $\alpha$ may encompass several zeros of the function $f(\theta)$ as is represented in FIG. 9.

Figure 10:
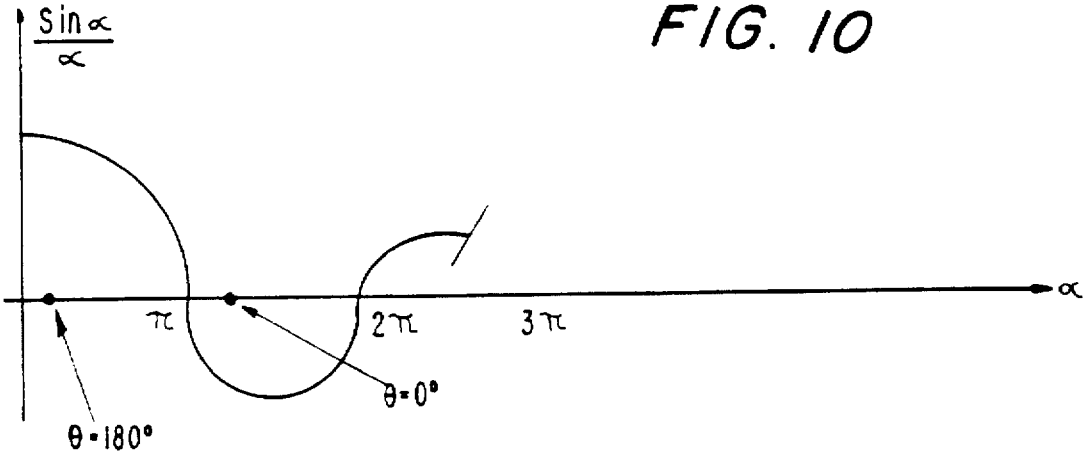

By choosing L to be sufficiently small, it is possible to reduce the interval of existence of $\alpha$, so that the function $\sin\alpha/\alpha$ can cancel out only once (see FIG. 10).

The value of $\theta$ corresponding to the zero of $\sin\alpha/\alpha$ is given by resolving the following equation:

$$(\sqrt{\epsilon_r} + \cos\theta)\pi L/\lambda = \pi \quad (20)$$

which has the solution:

$$\cos\theta = \frac{\lambda}{L} - \sqrt{\epsilon_r} \quad (21)$$

Let us return to expression (7) giving the direction of the maximum of the first secondary lobe k=2. Making the zeros of the radiation pattern of the slot coincide with the maximum of this lobe causes it to be eliminated.

In order to do this, let us identify the terms of expressions (21) and (7). It is deduced therefrom that it is possible to cancel the first secondary lobe, whatever the value of $\lambda$, if L obeys the following relation:

$$L = \frac{\lambda_{start}}{2(\sqrt{\epsilon_r} + 1)} \quad (22)$$

which, taking into account relation (2), can be expressed:

$$L=p/2 \quad (23)$$

Let us calculate the response of the slot for the principal lobe (k=1); it is obtained by replacing $\cos\theta_{max,1}$ by its value (6) in relation (13):

$$f(\theta_{max,1})=2L/\pi \quad (24)$$

Likewise, for the secondary lobes k=3 and the following ones, expressions (5) and (13) give:

$$f(\theta_{max,k}) = L\frac{\sin k\pi/2}{k\pi/2} \quad (25)$$

This expression is zero when k is even, and it results therefrom that all the even-order secondary lobes are completely canceled. The odd-order secondary lobes are, for their part, heavily attenuated. The most unfavorable case occurs for k=3, to which corresponds:

$$f(\theta_{max,3})=-2L/3\pi \quad (26)$$

The amplitude of this lobe is therefore one third of the amplitude of the principal lobe, i.e. 9.5 dB below the principal lobe, if the power levels are compared.

The amplitude of the secondary lobe k=5 is equal to:

$$f(\theta_{max,5})=-2L/5\pi \quad (27)$$

The amplitude is therefore five times lower than the principal mode, i.e. 14 dB if the power levels are compared.

Expression (25) shows that the higher the order of the secondary lobes, the more they are attenuated.

A pattern in accordance with the invention therefore makes it possible to obtain a frequency band without secondary lobe which is of the type $|f_{start}, 3\times f_{start}|$. If a certain degradation is accepted in performance levels, evaluated in terms of level of interference between the primary lobe and the secondary lobes (which are not completely eliminated), the radiating cable thus produced can be used beyond $3\times f_{start}$, since the fluctuations are nevertheless smaller than with a coupled-mode cable.

There exists a large variety of patterns making it possible to obtain the effect sought. In fact, the calculation of radiation pattern of a slot parallel to the axis of the line was obtained by integrating the contributions from infinitesimal segments of length dx.

A pattern of a similar shape would be obtained (in the plane of the axis of the cable) if the slot were oblique, and as long as its projection in the plane of the axis of the cable had a length equal to p/2. It should be noted that, in this case, all the slots have to be parallel so that the pattern is perfectly repetitive.

Likewise, instead of using a continuous slot which is parallel or oblique with respect to the axis, the effect sought could be obtained by producing several apertures close together, and producing a radiation pattern similar to that of a continuous slot. In fact this would amount to replacing the integral (10) by the sum of the contributions from each of the apertures. An equivalent result will be obtained as long as the apertures are numerous (at least six), all identical, and their projections into the plane containing the axis of the line are equidistant. It is not necessary for the apertures to be aligned along the same generatrix, since only the radiation pattern in the plane containing the axis of the cable is considered.

FIG. 4 represents several patterns producing the effect sought. The choice of one or the other of these patterns makes it possible to control the intensity of the radiation emitted by the cable.

Figure 11:
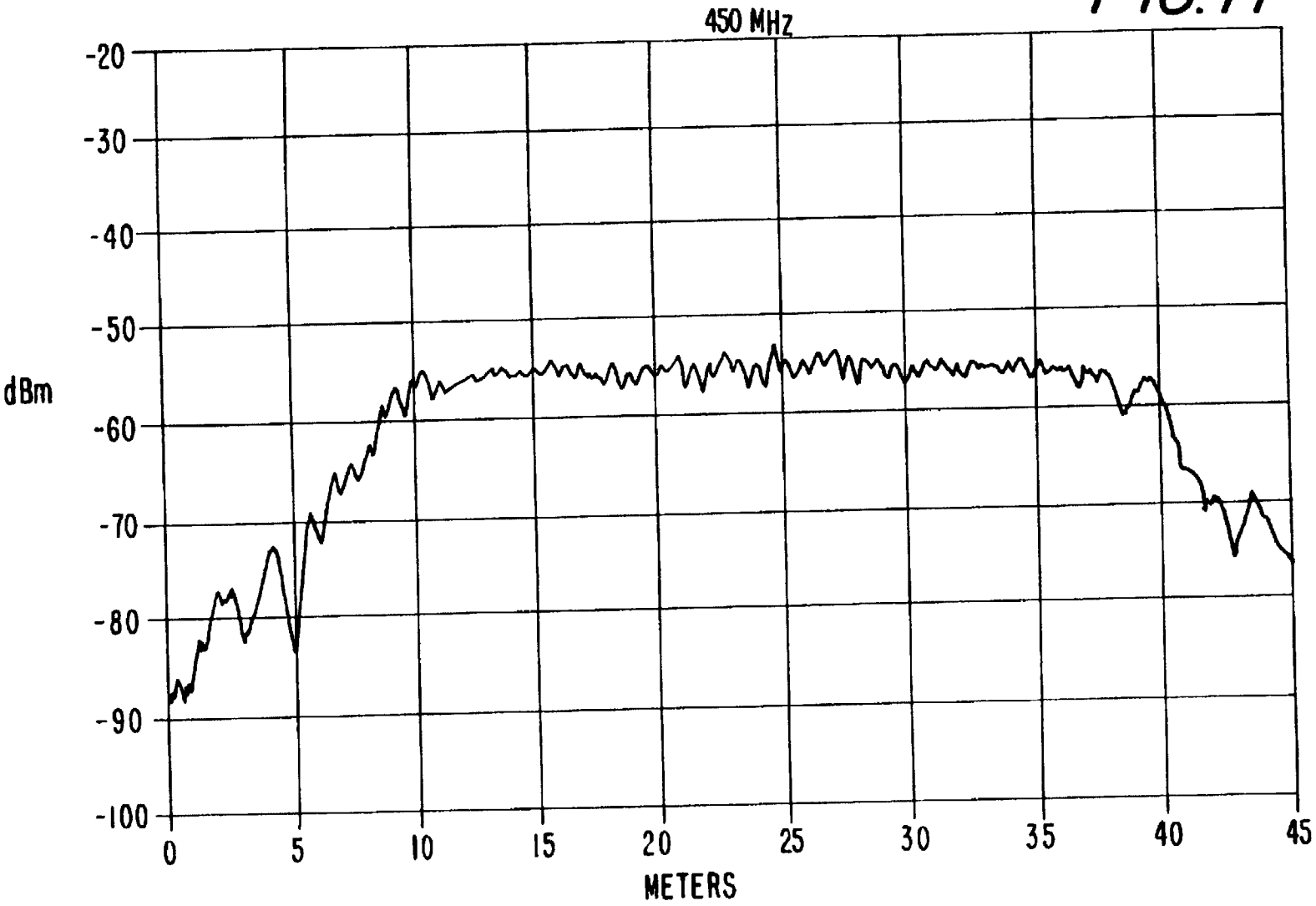
FIGS. 11 to 13 are diagrams illustrating the results obtained with a radiating cable according to the invention.
Figure 12:
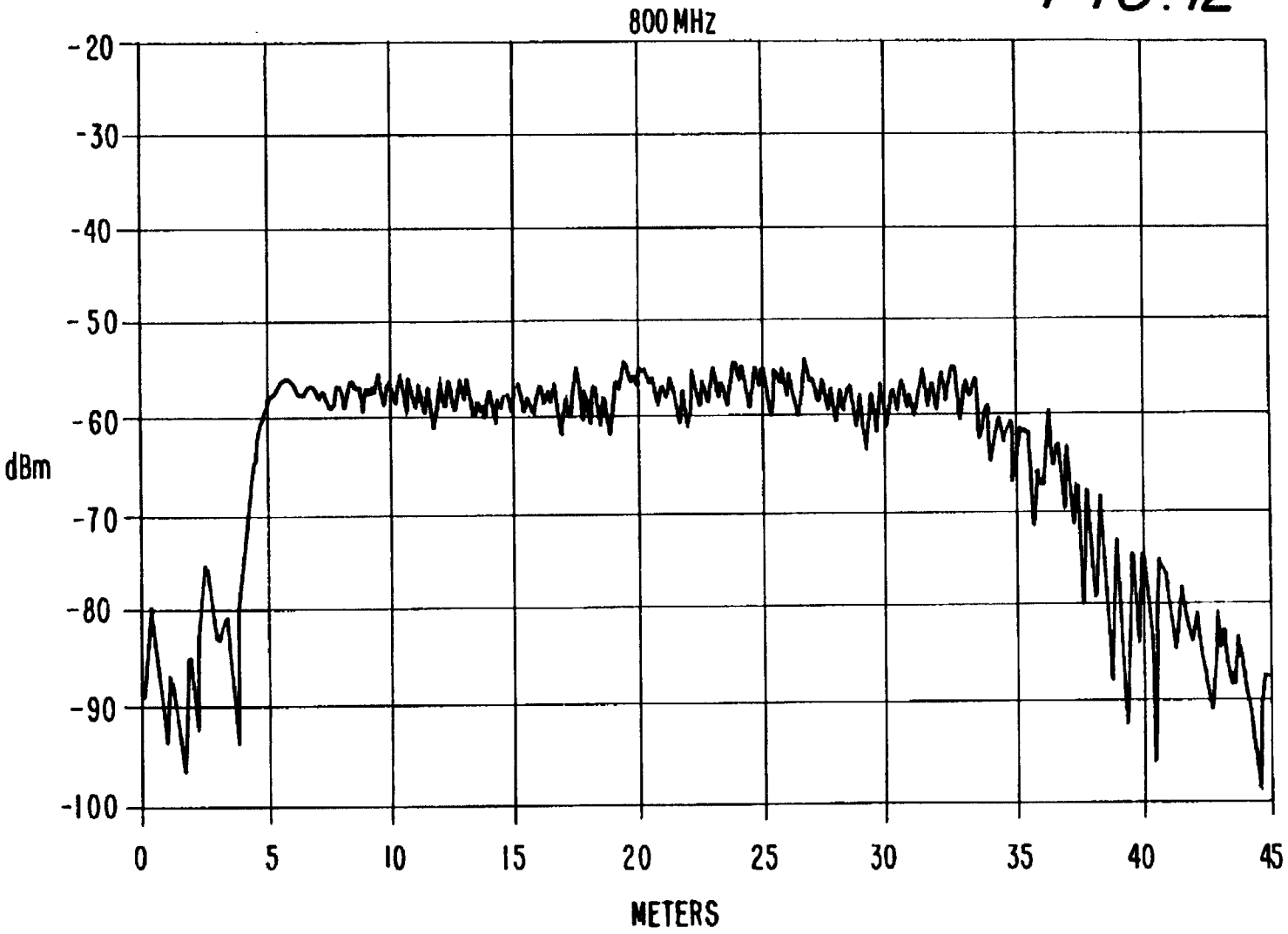
Figure 13:
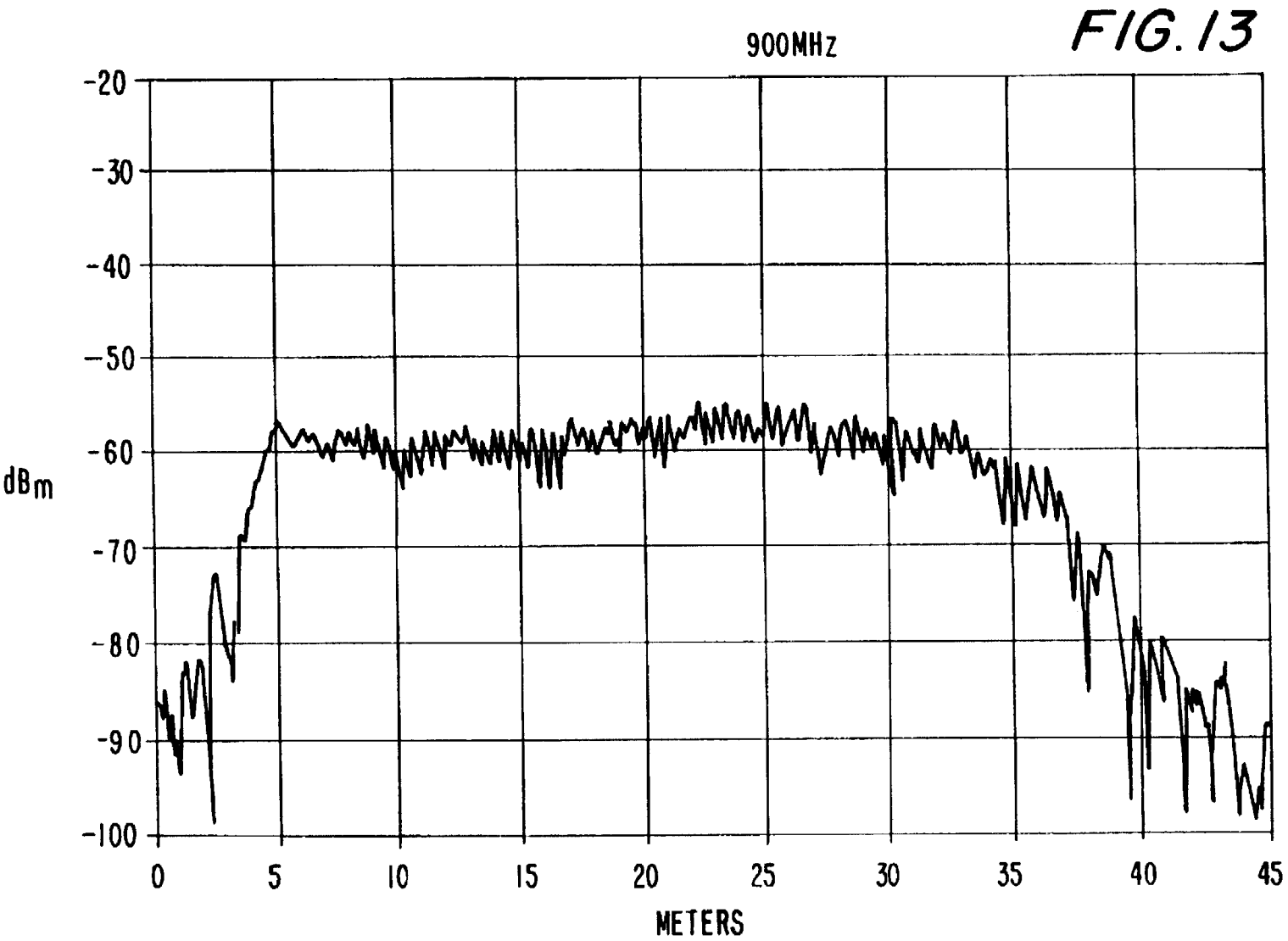

FIGS. 11, 12 and 13 present experimental results obtained with a radiating cable constructed according to the invention. These figures give the value of the power picked up by a dipole antenna along a trajectory parallel to the cable and 4 m distant. The axis of the abscissae corresponds to the distance covered (in m) and the axis of the ordinates represents the power picked up by the antenna, expressed in dBm (logarithmic unit). The cable tested is designed to operate in radiated mode at frequencies equal to or greater than 350 MHz; it lies between the abscissae 6 and 39 m. On the basis of what was said previously, a secondary mode should appear above 700 MHz, giving rise to strong fluctuations in the power picked up by the antenna. FIG. 11 corresponds to the frequency of 450 MHz, where only the mode k=1 exists. FIGS. 12 and 13 correspond respectively to frequencies of 800 and 900 MHz. It is noted that the amplitude of the fluctuations (peak-to-peak value) is, in the three cases, of the order of a few dB. As a reminder, when a secondary mode interferes with the primary mode, the fluctuations (peak-to-peak value) lie between 30 and 40 dB. FIGS. 12 and 13 therefore demonstrate clearly the effectiveness of the invention.

I claim:

1. A high frequency radiating line intended to radiate electromagnetic energy over a defined frequency band, said defined frequency band extending in increasing frequency from a minimum frequency at which the line radiates electromagnetic energy in a radial direction, which line comprises a tubular outer conductor including apertures configured to form a periodic pattern (M) repeated along said outer conductor with a predetermined pitch (p), said pitch being a fraction of a maximium wavelength, said maximum wavelength corresponding to said minimum frequency, said fraction being equal to $1/((\epsilon_r)^{1/2}+1)$ where $\epsilon_r$ is the relative dielectric constant of the line, wherein the periodic pattern (M) has a length (L) equal to $p/2\pm\Delta$, along a direction parallel to the axial direction of the line.

2. The line as claimed in claim 1, wherein $\Delta=10\%$ of $p/2$ approximately.

3. The line as claimed in claim 1, wherein the periodic pattern (M) consists of a slot extending along the generatrix of the outer conductor.

4. The line as claimed in claim 1, wherein the periodic pattern consists of a slot which is oblique with respect to the generatrix of the outer conductor.

5. The line as claimed in claim 1, wherein the periodic pattern consists of several identical apertures close together, the projections of which onto a plane containing the longitudinal axis of the line are equidistant.

6. The line as claimed in claim 5, wherein the periodic pattern (M) comprises at least six apertures.

* * * * *